United States Patent [19]

Thompson

[11] 4,408,140

[45] Oct. 4, 1983

[54] COMMUTATOR ASSEMBLY WITH HOOK MEMBERS

[75] Inventor: Ricky D. Thompson, Dayton, Ohio

[73] Assignee: General Motors Corporation, Detroit, Mich.

[21] Appl. No.: 326,802

[22] Filed: Dec. 2, 1981

[51] Int. Cl.[3] ..... H01R 39/16

[52] U.S. Cl. ..... 310/234; 310/235; 29/597

[58] Field of Search ..... 310/232–237, 310/219; 29/597; 174/138 R

[56] References Cited

U.S. PATENT DOCUMENTS

| | | | |
|---|---|---|---|
| 421,222 | 2/1890 | Alton | 310/236 |
| 499,350 | 6/1893 | Parshall | 310/236 |
| 2,297,464 | 9/1942 | Fleischmann | 310/234 |
| 2,645,732 | 6/1953 | Marsal | 310/234 |
| 2,668,923 | 2/1954 | Bondley | 310/236 |
| 3,473,063 | 10/1969 | Forste | 310/234 |
| 3,530,500 | 9/1970 | Jensen | 310/234 |
| 3,551,716 | 12/1970 | Jensen | 310/234 |
| 4,188,713 | 2/1980 | Kawano | 310/235 |

FOREIGN PATENT DOCUMENTS

| | | | |
|---|---|---|---|
| 1079541 | 11/1954 | France | 310/236 |
| 1214538 | 1/1959 | France | 310/236 |

OTHER PUBLICATIONS 319,355; Zollner; 5/18/43; Collectors for Electric Machines.

*Primary Examiner*—R. Skudy

*Attorney, Agent, or Firm*—Robert M. Sigler

[57] ABSTRACT

A commutator assembly for a dynamoelectric machine with metallic brushes has a plurality of composite carbon commutator bars retained on a generally cylindrical molded core with radial extensions and retaining lips at each axial end. A hook member for each bar has a U-shaped portion clamping one end of the bar and trapped in the molded core for retention of the bar against migration due to tangential brush force and a hook portion projecting outward for armature wire connection.

2 Claims, 4 Drawing Figures

COMMUTATOR ASSEMBLY WITH HOOK MEMBERS

BACKGROUND OF THE INVENTION

This invention relates to commutator assemblies for dynamoelectric machines of the type in which a metallic brush contacts commutator bars made of a composite carbon material. Such an arrangement of metallic brushes and carbon commutator bars has a number of advantages over the usual arrangement of metallic commutator bars and carbon brushes. The softer carbon composite material of the commutator bars increases slot tooling life and decreases the number of burrs created on the edge of the commutator bars. In addition, a narrower slot may be possible to help reduce commutator noise. A metallic brush in the form of a leaf spring reduces the mass and number of parts in the brush system for reduced noise and greater ease of assembly. With proper brush-spring pressure optimization, the possibility of reduced brush bounce with resultant reduced arcing and radio frequency interference is present. The simplicity of the arrangement may also allow size and weight reduction in the dynamoelectric machine.

However, this arrangement has its own problems which have prevented it from being utilized in any great volume. One of these problems is the migration of the commutator bars under the pressure of the spring during rotational operation. Since the composite carbon bars are separated and formed by axial slots cut through an annulus of carbon composite material mounted on a cylindrical core, the only anchoring of the bars on the core shown in the prior art has generally been the adhesive and/or friction between the core and the surface of each bar. This has often proven inadequate to positively maintain the commutator bars in their correct positions under the force of the metallic springs during rotational operation of the commutator apparatus.

SUMMARY OF THE INVENTION

Therefore, it is an object of this invention to provide a commutator assembly for a dynamoelectric machine having metallic brushes and carbon composite commutator bars in which the commutator bars are positively anchored to prevent migration under the pressure of the brush during rotational commutator operation.

It is a further object to provide such a commutator assembly in which the anchoring of the commutator bars is achieved in a manner which allows the noise, cost and manufacturing advantages of the carbon commutator and metallic brush arrangement.

These and other objects are obtained in a commutator assembly having a generally cylindrical core of a hard, molded, plastic, insulating material, a plurality of commutator bars of a composite carbon material affixed to the core in axial alignment and predetermined circumferential spacing for radial brush contact during operation of the commutator and a hook member for each bar made of an electrically conducting metal and comprising a U-shaped portion clamping one axial end of the associated bar, a hook portion projecting away from the associated bar for electrical armature wire connection thereto and a portion trapped in the core to positively anchor the commutator bar in its place to prevent migration in response to brush forces during operation of the commutator. Further details and advantages of this invention will be apparent from the accompanying drawings and following description of a preferred embodiment.

DESCRIPTION OF THE PREFERRED EMBODIMENT

Figure 1:
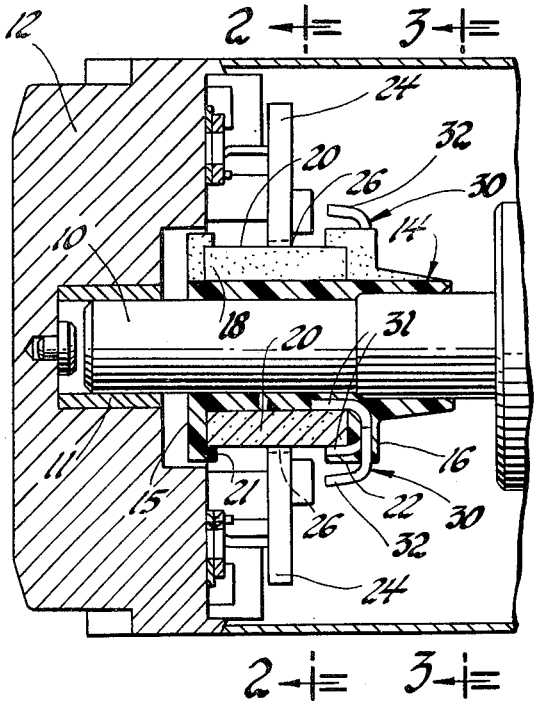
FIG. 1 shows an axial, partially sectional view of a commutator assembly of a dynamoelectric machine according to this invention.

FIG. 1 shows a portion of one axial end of a dynamoelectric machine in which one end of an armature shaft 10 is retained in a bearing 11 in end cap 12. Armature shaft 10 includes a laminated core 14 and armature windings; however, the windings are not shown in FIG. 1 so that the complete construction of the commutator assembly may be seen.

Figure 2:
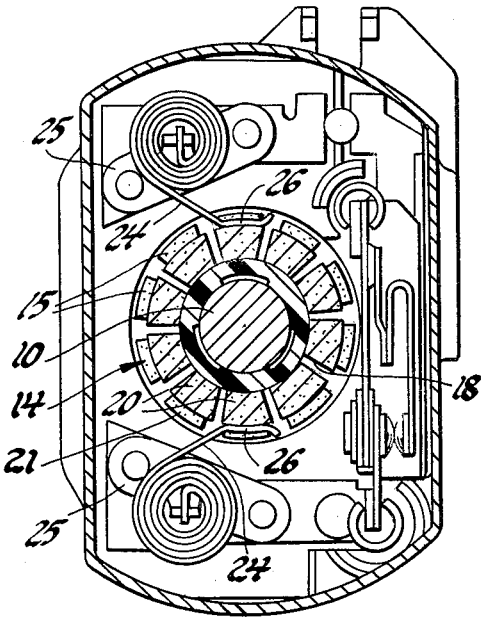
FIG. 2 shows a section view along lines 2—2 of FIG. 1.
Figure 3:
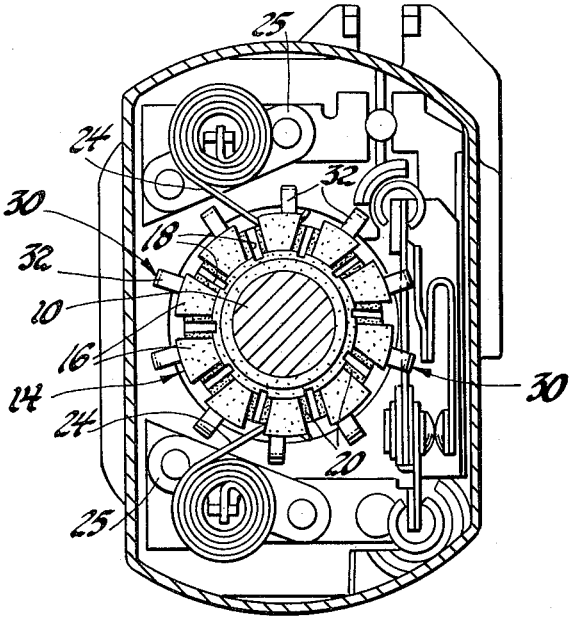
FIG. 3 shows a section view along lines 3—3 of FIG. 1.

The commutator assembly includes a generally cylindrical core molded from a glass filled phenolic resin and including at each axial end, as seen in FIGS. 1-3, a plurality of radial projections 15 and 16. In the assembly of the commutator, core 14 is molded within and partially around a cylinder or annulus of a composite carbon material which is later cut at grooves 18 as shown in FIG. 3 into a plurality of commutator bars 20. As shown in FIG. 1, each of the projections 15 and 16 includes retaining lips 21 and 22, respectively, to assist in the retention of commutator bar 20 after the formation of grooves 18.

Brushes 24 are formed as coiled spring contacts anchored on spring posts 25 and include contact portions 26 biased against the outer surface of commutator bars 20. Spring posts 25 connect with terminals in a standard manner for the transfer of electric power to or from the dynamoelectric machine.

Figure 4:
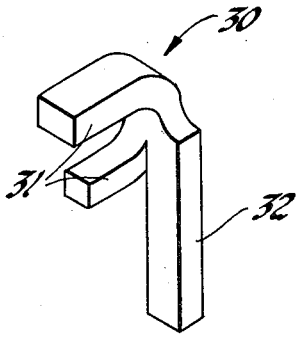
FIG. 4 shows a perspective view of a commutator hook member for use in the commutator assembly of FIG. 1.

A commutator hook is shown isolated in FIG. 4 and assembled in the commutator in FIG. 1. Commutator hook 30 is made of copper and generally comprises a first U-shaped portion 31 designed to clamp the end of a commutator bar 20 as shown in FIG. 1 and a contact or hook portion 32 which projects from the U-shaped portion 31 and serves as a binding post for the mechanical and electrical connection of a wire of the armature winding.

In assembly of the commutator, the U-shaped portions 31 of the commutator hooks 30 are clamped over one end of the composite carbon cylinder at the future locations of the respective commutator bars so that, when core member 14 is molded, at least a portion of the commutator hooks will be trapped within the molded core member 14. When grooves 18 are cut to form commutator bars 20, each bar has one end clamped by a U-shaped portion 31 of a hook 30. Hook portion 32 of each commutator hook 30 projects outward free of core member 14 for connection of an armature winding wire thereto. It can thus be seen that each commutator hook 30 simultaneously provides electrical connection between a commutator bar 20 and an armature winding wire and fixes that commutator bar 20 with reference to core member 14 so as to prevent migration of the commutator bar due to the tangential force of brush 24 during rotational commutator operation.

Since equivalent embodiments of this invention will occur to those skilled in the art, it should be limited only by the claims which follow.

The embodiments of the invention in which an exclusive property or privilege is claimed are defined as follows:

1. A commutator assembly for a dynamoelectric machine having metallic brushes, said assembly comprising:

a generally cylindrical core comprising a hard molded plastic insulating material;

a plurality of commutator bars comprising a composite carbon material, said bars being affixed to said core in axial alignment and predetermined circumferential spacing for radial brush contact during operation of the machine; and a plurality of commutator hook members, one being associated with each of said bars, each said hook member comprising an electrically conducting metal, and further comprising a substantially U-shaped portion clamping one axial end of its associated bar and a hook portion projecting away from said associated bar for electrical wire connection thereto, at least part of said hook member being trapped in said core, whereby its associated bar is prevented from migrating from its predetermined spacing and axial alignment in response to brush forces during operation of the machine.

2. A commutator assembly for a dynamoelectric machine having metallic brushes, said assembly comprising:

a generally cylindrical core comprising a hard molded plastic insulating material and having a plurality of radial extensions with a retaining lip at each axial end thereof;

a plurality of commutator bars comprising a composite carbon material, said bars being affixed to said core by said radial extensions and retaining lips for radial brush contact during operation of the machine; and a plurality of commutator hook members, one being associated with each of said bars, each said hook member comprising an electrically conducting metal, and further comprising a substantially U-shaped portion clamping one axial end of its associated bar, a hook portion projecting away from said associated bar for electrical wire connection thereto, the U-shaped portion being substantially trapped in said molded core to prevent migration of the associated bar in response to tangential brush forces during operation of the machine.

* * * * *